US006153819A

United States Patent [19]

Yorba

[11] Patent Number: 6,153,819

[45] Date of Patent: Nov. 28, 2000

[54] NOTE RELEASE CONTROL METHOD FOR SOLENOID ACTUATED PIANO ACTIONS

[75] Inventor: Alana J. Yorba, Carmichael, Calif.

[73] Assignee: Burgett, Inc., Sacramento, Calif.

[21] Appl. No.: 09/294,459

[22] Filed: Apr. 19, 1999

[51] Int. Cl.[7] ..... G10F 1/02; G10C 3/12

[52] U.S. Cl. ..... 84/20; 84/439; 84/440

[58] Field of Search ..... 84/17–21, 433, 84/439, 440

[56] References Cited

U.S. PATENT DOCUMENTS 5,650,580 7/1997 Yamamoto et al. .
5,756,910 5/1998 Fields et al. ..... 84/20
5,880,393 3/1999 Kaneko et al. ..... 84/662
5,922,983 7/1999 Muramatsu ..... 84/626

*Primary Examiner*—Bentsu Ro
*Assistant Examiner*—Marlon T. Fletcher
*Attorney, Agent, or Firm*—John P. O'Banion

[57] ABSTRACT

A method for eliminating or reducing noise created by the action mechanisms of piano keys during its return stroke after striking a string, by regulating the amount of time for the mechanism to return to rest. The method comprises the steps of sequentially initiating a pair of braking pulses by the actuator solenoid to slow the action mechanism during its return stroke. Each braking pulse is of a specified duration and magnitude such that the mechanism's return time is maximized while eliminating the possibility of double hits on the string.

26 Claims, 3 Drawing Sheets

NOTE RELEASE CONTROL METHOD FOR SOLENOID ACTUATED PIANO ACTIONS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention pertains generally to musical instruments, and more particularly to an apparatus and method for regulating the time for a piano key to return to rest after the key has been depressed.

2. Description of the Background Art

Automatic playing piano systems utilize actuator units, such as solenoids, to sequentially rotate the piano keys for reproducing a musical performance. A problem encountered with such automatic playing piano systems is the creation of mechanical noise from each key's action mechanism returning to its rest position after being actuated by the solenoid to strike a piano string. Such mechanical noise is apparent in all piano action mechanisms. This problem becomes more evident especially when the musical performance is played at low volumes, as opposed to higher volumes where the sounds produced by the strings help mask the mechanical noise from the piano action.

A known method to reduce and/or eliminate the mechanical noise is to reduce the rate of return of the action mechanisms to their respective rest positions. One method in particular employs a three step constant deceleration to silence the noise created by the action mechanism on electronic keyboards by applying a force to the solenoid actuator corresponding to the key's action mechanism to slow the mechanism's return to its rest position. This method presents problems in faithfully reproducing a piano performance. Because of the constant deceleration of the action mechanism, its return time is dramatically slowed. For example, a grand piano with an "unbraked" return time of approximately 35 milliseconds will have a "braked" return time of approximately 55 milliseconds. Trills (quick repetition of key strikes) will be missed because the obtainable repetition rate is reduced. Moreover, undesirable double hits of the string can easily occur due to the increased braking force caused by the solenoid actuators.

Accordingly, there exists a need for a method to regulate the return rate for a piano key's action mechanism, which maximizes the return rate and decreases the braking force required to regulate the return rate. The present invention satisfies these needs, as well as others, and generally overcomes the deficiencies found in the background art.

BRIEF SUMMARY OF THE INVENTION

The present invention employs a braking method having a shortened braking period to regulate the return rate of a piano action mechanism. The method generally comprises sequentially applying a pair of decelerating pulses, at specified intervals and for specified durations by the actuating solenoid to the action mechanism, and terminating the pulses abruptly to allow for the maximum fall rate possible of the action mechanism. The braking force is applied to the solenoid for only a brief period of time, eliminating the chance of double hits. Using this method, return time of the action mechanism to rest is increased by only 3 to 4 milliseconds. For example, a grand piano having an unbraked return time of approximately 35 milliseconds will have a braked return time of approximately 38 milliseconds. Because return braking occurs for a brief period of time, the note is ready for quick repeat play (trill), ultimately resulting in a more faithful reproduction of the original performance.

An object of the invention is to quiet mechanical noise created when a piano action mechanism returns to rest after a string strike.

Another object of the invention is to regulate the time for the action mechanism to return to its rest position after being actuated.

Another object of the invention is to regulate a piano action mechanism return to its rest position by minimizing the action mechanism's return time.

Still another object of the invention is to regulate a piano action mechanism return time using a two step braking pulse.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Figure 1:
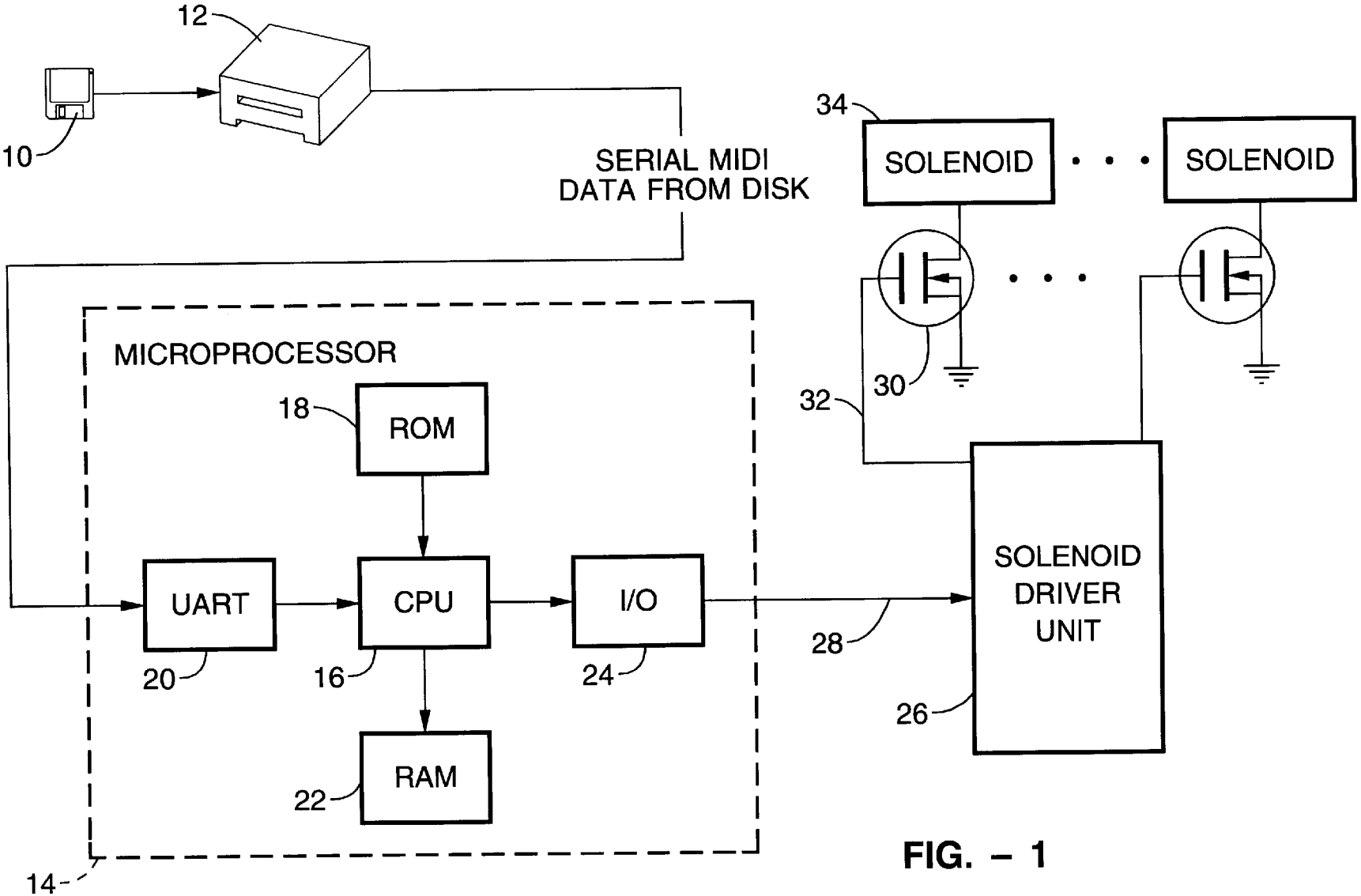
FIG. 1 is functional block diagram of an apparatus for activating solenoids in connection with which the present invention can be practiced.

Referring more specifically to the drawings, for illustrative purposes the present invention is described in context of the apparatus generally shown in FIG. 1. It will be appreciated, however, that the apparatus may vary as to configuration and as to details of the parts and that the method of the invention described herein may vary as to the steps and their sequence without departing from the basic concepts as disclosed herein.

The present invention relates to a note release control method for use in connection with an apparatus for actuating solenoids in a player piano. Such an apparatus would generally utilize musical information recorded on magnetic disk in Musical Instrument Digital Interface (MIDI) format which has become an industry standard. Once musical information is recorded in MIDI, the information can be manipulated by a computer using standard editing techniques. For example, sections of the music can be duplicated, bad notes can be corrected, and any other desired musical operation can be performed.

MIDI is a serial communications standard that provides a common language for the transmission of musical events in real time. The MIDI specification allows up to sixteen channels of information to be carried by a single cable, and each channel contains data about what notes are to be played, how loud they will be, what sounds will be used and how the music will be phrased. Contained within these data channels are velocity factors which are coded from 0 to 128, the highest velocity corresponding to the highest velocity factor. The present invention utilizes those velocity factors to accurately re-create the expression of the original recorded music on a solenoid actuated musical instrument such as a player piano system.

Referring to FIG. 1, in an exemplary apparatus in connection with which the present invention would be used, prerecorded media 10 containing music to be reproduced is read by a playback unit 12. Media 10 can be any conventional magnetic or optical storage media or the like, and playback unit 12 can be any corresponding conventional media reader. Coupled to playback unit 12 is control microprocessor unit (MPU) 14 which selects the solenoid driving parameters for each driving signal corresponding to a particular velocity factor. A core element of MPU 14 is CPU 16, a central processor at the heart of the system. Coupled to CPU 16 is ROM 18, which contains in read only memory the solenoid driving parameters for the various velocity factors as well as the operating software for CPU 16. Also coupled to CPU 16 is UART 20, a serial data receiver which receives the serial MIDI data from playback unit 12 and routes it to CPU 16. RAM 22, which contains changeable program data, is also coupled to CPU 16, as are I/O drivers 24 which couple MPU 14 to a solenoid driving circuit 26 through an address/data bus 28. Solenoid driver circuit 26 then converts the solenoid driving parameters into a pulse width modulated signal which drives one of several FET drivers 30 through a corresponding control line 34. The FET driver 30 in turn activates a corresponding solenoid 34 through a control line 36. MPU 14 is typically a Dallas Semiconductor DS87C520 or the like, and conventional circuitry and circuit elements are utilized throughout.

MPU 14 decodes a note and corresponding velocity factor from the recorded media 10 and assigns a particular driving signal to that velocity factor as discussed below. The note data will determine which of the solenoids 34 will be activated by solenoid driver circuit 26, and the driving signal will re-create the expression of the note played. Additional details of related circuitry and operational methodology can be found in U.S. Pat. No. 5,756,910, which is incorporated herein by reference.

The note release control method of the present invention eliminates or reduces noise created by the piano action mechanism as it returns to a rest position after being actuated to strike a string. The method is preferably implemented in software associated with MPU 14 described above which those skilled in the art will appreciate can be implemented using conventional programming techniques. In addition to use in connection with the solenoid actuation apparatus described above, this method of noise reduction is applicable to any automatic piano system wherein the actuator solenoid also actuates the action mechanism to sound a note as part of a pre-programmed musical performance.

Figure 2:
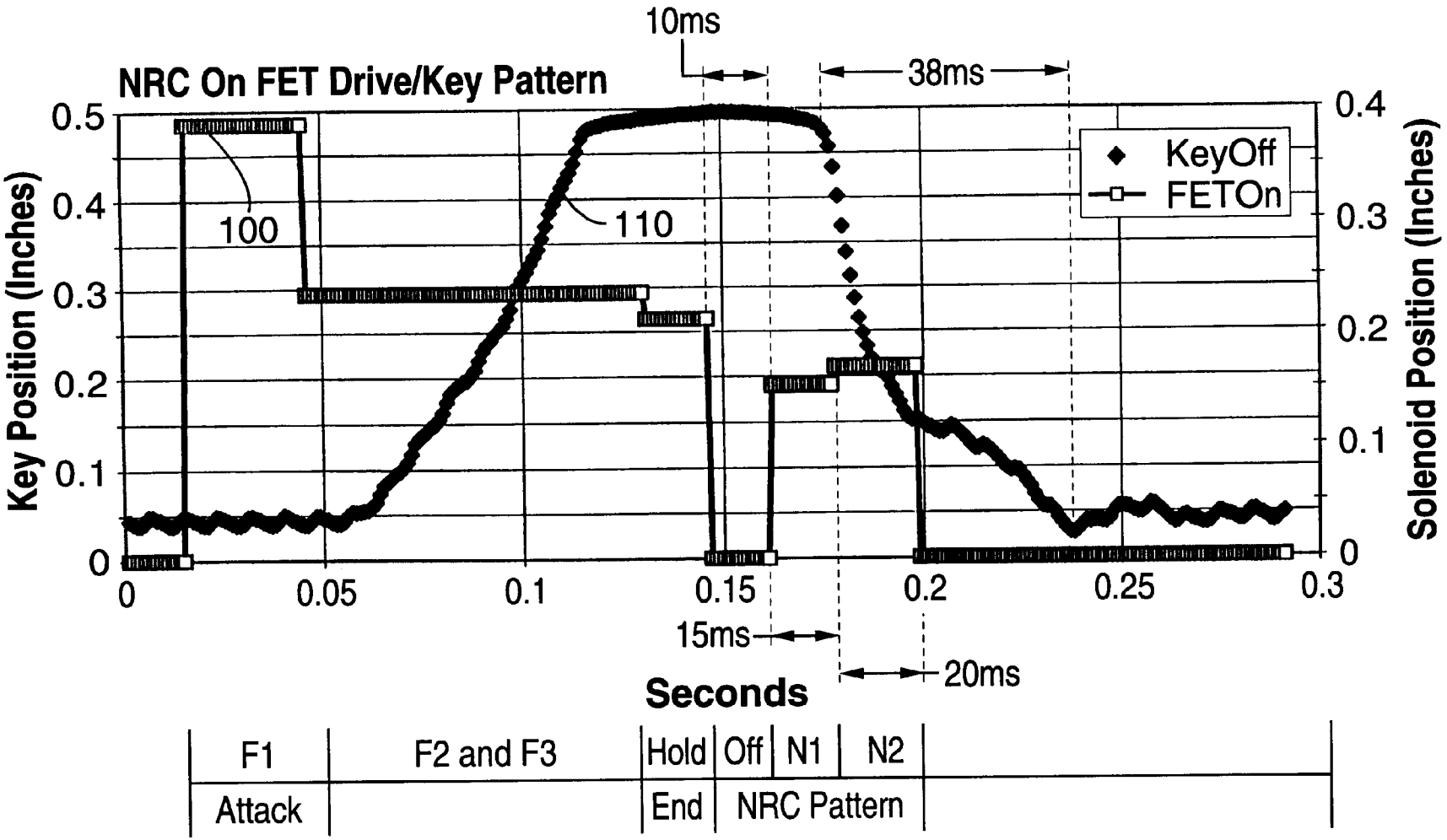
FIG. 2 is a graph showing the position of the piano key and solenoid relative to time using the method of the present invention.

FIG. 2 is a graph showing the duty cycle of the solenoid and the piano key position with the note release control method of the present invention applied. The left vertical scale corresponds to the position of the key in inches above its state of rest, the right vertical axis corresponds to the duty cycle of the solenoid in inches and the horizontal axis corresponds to time in milliseconds. The dashed line 100 represents the duty cycle of the solenoid and the solid line 110 represents the piano key position. The piano's key action mechanism is actuated by the solenoid during the pulse cycle Fl, which moves the key and action past statical friction and accelerates the hammer towards the string. The trough cycle F2 continues the key motion to commit the hammer to strike the string at a force lower than the pulse cycle Fl without increasing the key's velocity. In the clamp cycle F3, the solenoid maintains the hammer against the string to prevent recoil of the hammer from the string. The solenoid is de-energized at the end of the clamp cycle F3 after the string is struck and the key's action mechanism begins to return to rest.

The note release control method regulates the time for the piano action mechanism to return to rest by utilizing a pair of sequential deceleration pulses N1, N2 by the solenoid to decelerate the key's action mechanism as the mechanism is on its return stroke, after an OFF period, wherein no force is applied to the solenoid (key-off). The first deceleration pulse N1 by the solenoid is initiated after the OFF period of approximately 10 milliseconds after the end of the clamp cycle F3. First deceleration pulse N1 by the solenoid has sufficient magnitude to gently brake the fall of the key action mechanism so that an inadvertent restrike of the string does not occur. If a greater force is applied by the solenoid at this point, the hammer would bounce towards the string causing an undesirable restrike of the key. First deceleration pulse N1 is applied for approximately 15 milliseconds. At the end of first deceleration pulse N1, a second deceleration pulse N2 having a greater magnitude than first deceleration pulse N1 is applied by the solenoid onto the key action mechanism. Second deceleration pulse N2 arrests the noise created by the whippen and the related mechanical parts in the key's action mechanism. Second deceleration pulse N2 is applied for approximately 20 milliseconds, after which the solenoid is de-energized, allowing the key to return to rest.

Deceleration pulses N1, N2 are terminated abruptly at the ends of their respective cycles to allow for the maximum key fall rate possible, thus availing the note for trill performance resulting in a more faithful reproduction of the original performance. It can be seen that the total fall time of the braked key action mechanism is approximately 38 milliseconds.

Figure 3:
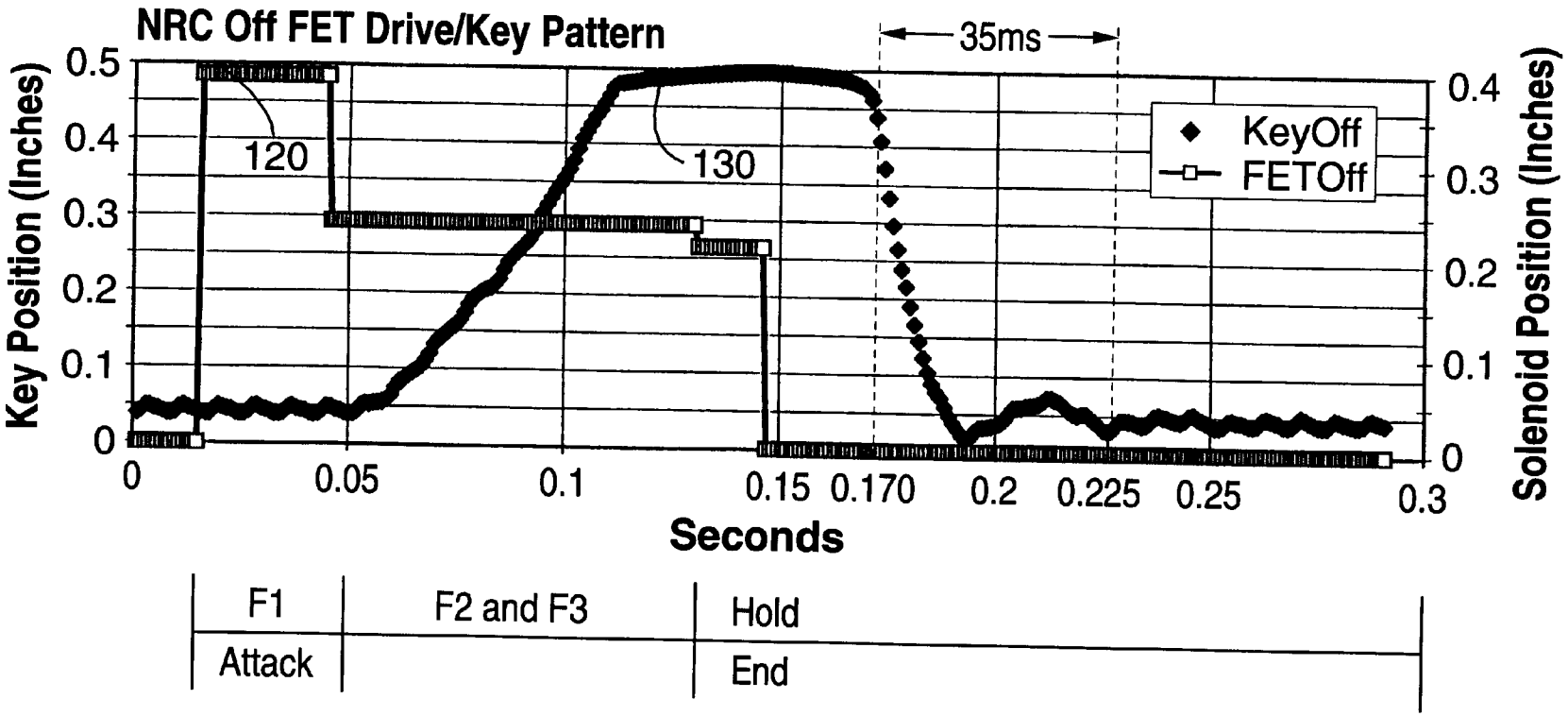
FIG. 3 is a graph showing the position of the piano key and solenoid relative to time without the method of the present invention.

FIG. 3 shows the duty cycle of the solenoid and the piano key position without the note release control method applied. The dashed line 120 represents the duty cycle of the solenoid and the solid line 130 represents the piano key position. The solenoid is de-energized and remains so after the end of the clamp cycle F3, allowing the key action mechanism to freely fall to its rest position. It can be seen that the fall time of the unbraked key's action mechanism is approximately 35 milliseconds, with a difference of approximately only 3 milliseconds attributed to the OFF period and deceleration pulses N1, N2. The timing and magnitude of each deceleration pulse of the note release control method is advantageous over a constant deceleration of the key's action mechanism as it minimizes fall time so that trill rate still remains high, and the short duration of deceleration pulses N1, N2 eliminate the occurrence of double hits on the string.

Accordingly, it will be seen that this invention provides a unique method for eliminating noise created during the return to rest of a piano's key action mechanism and the chance of double hits without sacrificing trill performance. Although the description above contains many specificities, these should not be construed as limiting the scope of the invention but as merely providing illustrations of some of the presently preferred embodiments of this invention. Thus the scope of this invention should be determined by the appended claims and their legal equivalents.

What is claimed is:

1. A method for eliminating or reducing mechanical noise during the return phase of the keys and action mechanisms of an automatic playing piano having solenoid actuated keys, comprising the steps of:

(a) applying a first braking force from a solenoid actuator after solenoid key-off for a specified duration, said braking force having a first magnitude and a first duration;

(b) terminating said first braking force from said solenoid actuator; and (c) applying a second braking force from said solenoid actuator, said second braking force having a second magnitude and a second duration;

(d) wherein said first duration is approximately 15 milliseconds, and wherein said second duration is approximately 20 milliseconds.

2. A method as recited in claim 1, wherein said first magnitude is less than said second magnitude.

3. A method as recited in claim 1, wherein said first braking force is applied approximately 10 milliseconds after said solenoid key-off.

4. A method as recited in claim 1, wherein said second braking force is applied simultaneously with said terminating of said first braking force.

5. A method for eliminating or reducing mechanical noise during the return phase of the keys and action mechanisms of an automatic playing piano having solenoid actuated keys, comprising the steps of:

(a) applying a first braking force from a solenoid actuator after solenoid key-off for a specified duration, said braking force having a first magnitude and a first duration;

(b) terminating said first braking force from said solenoid actuator; and (c) applying a second braking force from said solenoid actuator, said second braking force having a second magnitude and a second duration, wherein said first magnitude is less than said second magnitude, and wherein said first duration is approximately 15 milliseconds, and wherein said second duration is approximately 20 milliseconds.

6. A method as recited in claim 5, wherein said first braking force is applied approximately 10 milliseconds after said solenoid key-off.

7. A method as recited in claim 5, wherein said second braking force is applied simultaneously with said terminating of said first braking force.

8. A method for eliminating or reducing mechanical noise during the return phase of the keys and action mechanisms of an automatic playing piano having solenoid actuated keys, comprising the steps of:

(a) applying a first braking force from a solenoid actuator after solenoid key-off for a specified duration, said braking force having a first magnitude and a first duration;

(b) terminating said first braking force from said solenoid actuator; and (c) applying a second braking force from said solenoid actuator simultaneously with said terminating of said first braking force, said second braking force having a second magnitude and a second duration, wherein said first magnitude is less that said second magnitude, and wherein said first duration is less than said second duration.

9. A method as recited in claim 8, wherein said first duration is approximately 15 milliseconds, and wherein said second duration is approximately 20 milliseconds.

10. A method as recited in claim 8, wherein said first braking force is applied approximately 10 milliseconds after said solenoid key-off.

11. A method for eliminating or reducing mechanical noise during the return phase of the keys and action mechanisms of an automatic playing piano having solenoid actuated keys, comprising the steps of:

(a) applying a first braking force from a solenoid key actuator approximately 10 milliseconds after solenoid key-off, said braking force having a first magnitude and a first duration;

(b) terminating said first braking force from said solenoid key actuator; and (c) applying a second braking force from said solenoid key actuator, said second braking force having a second magnitude and a second duration.

12. A method as recited in claim 11, wherein said first duration is less than said second duration.

13. A method as recited in claim 12, wherein said first duration is approximately 15 milliseconds, and wherein said second duration is approximately 20 milliseconds.

14. A method as recited in claim 11, wherein said first magnitude is less than said second magnitude.

15. A method as recited in claim 11, wherein said second braking force is applied simultaneously with said terminating of said first braking force.

16. A method for eliminating or reducing mechanical noise during the return phase of the keys and action mechanisms of an automatic playing piano having solenoid actuated keys, comprising the steps of:

(a) applying a first braking force from a solenoid actuator after solenoid key-off, said braking force having a first magnitude and a first duration;

(b) terminating said first braking force from said solenoid actuator; and (c) applying a second braking force from said solenoid actuator, said second braking force having a second magnitude and a second duration;

(d) wherein said second braking force is applied simultaneously with said terminating of said first braking force.

17. A method as recited in claim 16, wherein said first duration is less than said second duration.

18. A method as recited in claim 16, wherein said first duration is approximately 15 milliseconds, and wherein said second duration is approximately 20 milliseconds.

19. A method as recited in claim 16, wherein said first magnitude is less than said second magnitude.

20. A method as recited in claim 16, wherein said first braking force is applied approximately 10 milliseconds after said solenoid key-off.

21. A method for eliminating or reducing mechanical noise during the return phase of the keys and action mechanisms of an automatic playing piano having solenoid actuated keys, comprising the steps of:

(a) applying a first braking force from a solenoid key actuator approximately 10 milliseconds after solenoid key-off, said braking force having a first magnitude and a first duration;

(b) terminating said first braking force from said solenoid key actuator; and (c) applying a second braking force from said solenoid key actuator, said second braking force having a second magnitude and a second duration;

(d) wherein said first magnitude is less that said second magnitude, and wherein said first duration is less than said second duration.

22. A method as recited in claim 21, wherein said first duration is approximately 15 milliseconds, and wherein said second duration is approximately 20 milliseconds.

23. A method as recited in claim 21, wherein said second braking force is applied simultaneously with said terminating of said first braking force.

24. A method for eliminating or reducing mechanical noise during the return phase of the keys and action mechanisms of an automatic playing piano having solenoid actuated keys, comprising the steps of:

(a) applying a first braking force from a solenoid key actuator after solenoid key-off, said braking force having a first magnitude and a first duration;

(b) terminating said first braking force from said solenoid key actuator; and (c) applying a second braking force from said solenoid key actuator, said second braking force having a second magnitude and a second duration;

(d) wherein said first magnitude is less that said second magnitude, wherein said first duration is less than said second duration, and wherein said second braking force is applied simultaneously with said terminating of said first braking force.

25. A method as recited in claim 24, wherein said first duration is approximately 15 milliseconds, and wherein said second duration is approximately 20 milliseconds.

26. A method as recited in claim 24, wherein said first braking force is applied approximately 10 milliseconds after said solenoid key-off.

* * * * *